United States Patent [19]

Tran et al.

[11] 4,146,811

[45] Mar. 27, 1979

[54] EXTRACTIVE ELECTRODE SITUATED IN THE VICINITY OF THE PARTICLE SOURCE OF ACCELERATORS OF THE CYCLOTRON TYPE

[75] Inventors: Duc T. Tran; Jacques Kervizic; Bernard Hurt, all of Paris, France

[73] Assignee: C.G.R. MeV, Paris, France

[21] Appl. No.: 858,399

[22] Filed: Dec. 7, 1977

Related U.S. Application Data

[63] Continuation of Ser. No. 706,598, Jul. 19, 1976, abandoned.

[30] Foreign Application Priority Data

Jul. 21, 1975 [FR] France ..... 75 22718

[51] Int. Cl.[2] ..... H01J 1/94; H05H 13/00

[52] U.S. Cl. ..... 313/62; 313/146; 313/237; 313/326; 313/363

[58] Field of Search ..... 313/62, 326, 237, 363, 313/146; 328/234

[56] References Cited

U.S. PATENT DOCUMENTS 2,716,197 8/1955 Jones et al. ..... 313/62 X 3,867,705 2/1975 Hudson et al. ..... 328/234

OTHER PUBLICATIONS

"The Central Region of the Delft 12 MeV Isochronous Cyclotron," by B. Lubach, *Nuclear Instruments and Methods,* 89, No. 1, (1970), pp. 141-146, North-Holland Publishing Co.

*Primary Examiner*—Palmer C. Demeo

*Attorney, Agent, or Firm*—Oblon, Fisher, Spivak, McClelland & Maier

[57] ABSTRACT

An extractive electrode allowing to reduce the vertical focusing and defocusing effect of the hyperfrequency electrical field used for accelerating the particles of a beam within an accelerator of cyclotron type. The extractive electrode comprises a metallic block having a substantially prismatic shape and provided in its entry face facing the particle source with at least a window which opens onto a deep notch delimited by two curved lateral walls forming a channel C for the passage of the beam. A median element located within this channel C allows to obtain two separated channels for the passage of the two beams corresponding to two harmonic operating frequencies.

11 Claims, 10 Drawing Figures

EXTRACTIVE ELECTRODE SITUATED IN THE VICINITY OF THE PARTICLE SOURCE OF ACCELERATORS OF THE CYCLOTRON TYPE

This is a continuation, of application Ser. No. 706,598, filed July 19, 1976, and now abandoned.

This invention relates to improvements in the extractive electrode positioned in the vicinity of the particle source substantially located in the centre of accelerators of the cyclotron type, this improved extractive electrode making it possible to reduce the vertical focusing and defocusing effects attributable to the hyperfrequency electrical accelerator field created between the "Dees" and the mass of a cyclotron (or a synchrocyclotron).

In a cyclotron, the beam of particles issuing from the particle source situated in the vicinity of its centre is subjected to a hyperfrequency electrical accelerator field and to a magnetic field which enable the path followed by the beam to develop in spiral form in the "Dees".

Acceleration is obtained after each rotation through a predetermined angle $\theta$ by means of a hyperfrequency accelerator field created in the accelerating spaces between the "Dees."

The value of the magnetic field is normally higher in the central zone of the cyclotron so as to ensure suitable focusing of the beam during its initial revolutions. However, according to the phase of the hyperfrequency electrical field, the particles passing through the accelerator space are defocused or focused by the hyperfrequency electrical field and may become lost in the walls of the accelerator because an excessive focusing or defocusing, resulting in a reduction in the "effective phase" zone.

The extrative electrode according to the present invention makes it possible to reduce the vertical focusing or defocusing effect which the accelerating hyperfrequency electrical field has upon the beam of particles.

It is an object of the invention to provide an extractive electrode intended to be positioned in the vicinity of the source of the charged particle beam of an accelerator of the cyclotron type, said particle source being substantially located in the center of said cyclotron, said accelerator comprising at least two electrodes or "Dees" situated between the pole pieces of an electromagnet and means enabling an hyperfrequency electrical accelerator field to be created in the accelerating spaces between these "Dees" for periodically accelerating the beam, said extractive electrode being formed by a metallic block substantially prismatic in shape, and removable fixed to one of said Dees said extractive electrode having an entry face facing said particle source and an exit face, said entry face being provided with at least one window for the passage of said beam, said window opening onto a deep notch formed into said block, said notch being only delimited by two curved lateral walls constituting a channel for the passage of said beam, said channel opening at the exit face onto one of said accelerating spaces, said hyperfrequency electrical field having in this channel a component of low value along a line perpendicular to the plane of the mean path of said beam.

A further object of the invention is to provide an extractive electrode for a cyclotron operating at frequencies of different harmonic orders, said extractive electrode having two windows for the passage of two particle beams, said windows opening respectively onto two deep notches formed into said block, said notches being delimited to two curved lateral walls and a curved median element arranged between said lateral walls for forming two channels for the passage of the particles, said channels opening at the exit face of said extractive electrode, onto one of said accelerating spaces, said hyperfrequency electrical field having in said channels a component of low value along a line perpendicular to the plane of the mean path of said particles.

For a better understanding of the invention and to show how the same may be carried into effect, reference will be made to the drawings, given solely by way of example, which accompany the following description and wherein.

Figure 1:
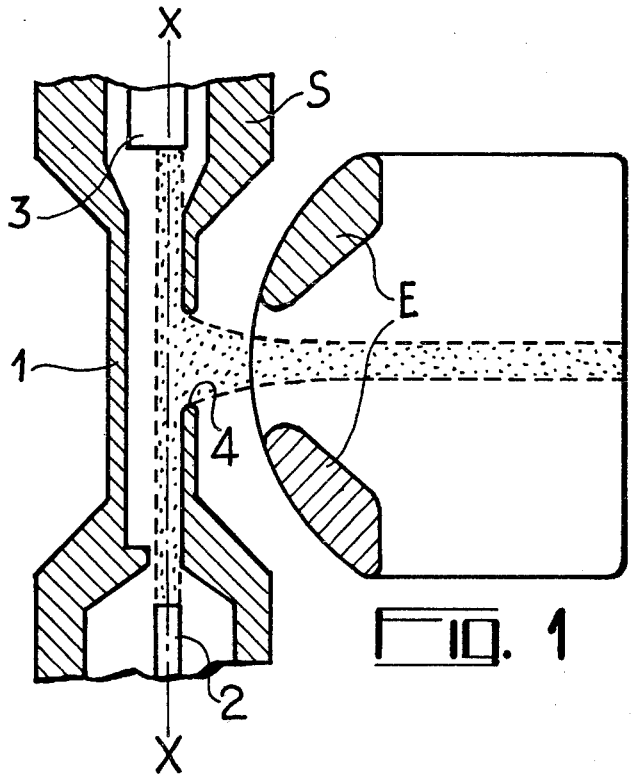
FIG. 1 illustrates an ion source associated with an extractive electrode according to the invention.

An accelerator of the cyclotron type comprises at its centre a particle source S (for example an ion source), as illustrated in FIG. 1, this ion source being generally formed by a metallic tube 1 of narrow cross-section, at the two ends of which a cathode 2 and an anticathode 3, respectively, are arranged for ionisation of the gas introduced into the tube 1. A magnetic field created along the axis XX of the tube 1 or "source body" ensures suitable confinement of the plasma obtained in the tube 1. An extractive electrode E is arranged outside the "source body" 1 in front of a slot 4 formed in the centre thereof. If the particles are ions, they are extracted from the source 1 during the negative alternation of the high frequency electrical field.

Figure 2:
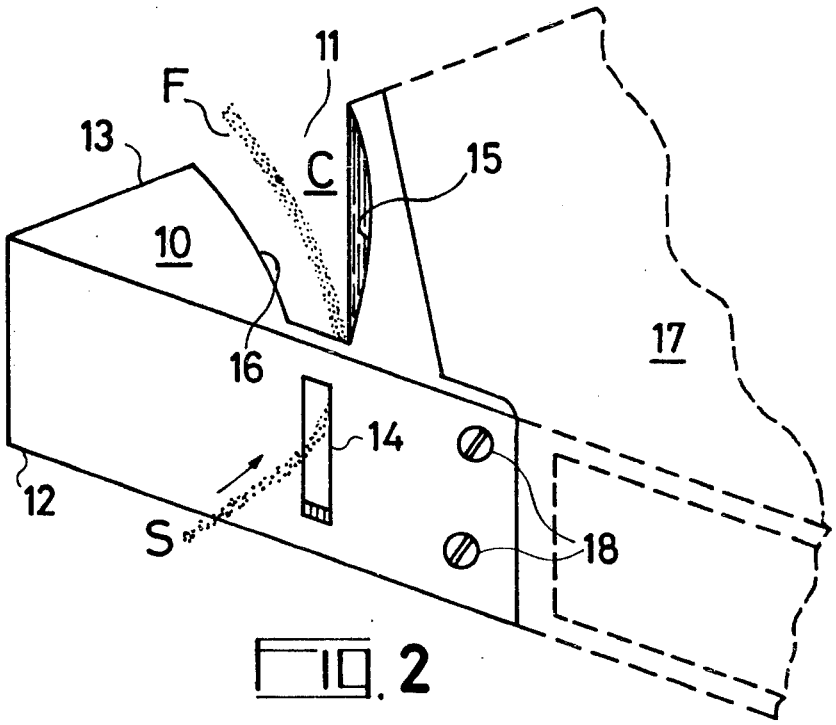

FIG. 2 shows one example of embodiment of an extractive electrode according to the invention. This extractive electrode is formed by a metallic block 10 (for example of copper) substantially prismatic in shape and comprising an entry face 12 and an exit face 13. The entry face 12 comprises a window 14 intended to be positioned in front of the particle source S. This window 14 opens onto a deep notch 11 which becomes progressively wider and opens at the exit face 13. This notch 11 forms a channel C constituting a passage for the beam F of particles, this passage C being defined by lateral walls 15 and 16, the form of which is determined by the characteristics of the beam and the magnetic field. The metallic block 10 forming the extractive electrode according to the invention may be mechanically fixed to the edge of one of the "Dees" 17, for example by means of screws 18 (FIG. 2). The channel C is open at its upper and lower ends so as to eliminate the vertical focusing and defocusing effects to which the particle beam is normally subjected, these focusing and defocusing effects being due to that component of the hyperfrequency electrical field which is perpendicular to the plane of the mean trajectories of said beam. From this point of view, the channel C will be more effective, the smaller its width in relation to its height.

Figure 3:
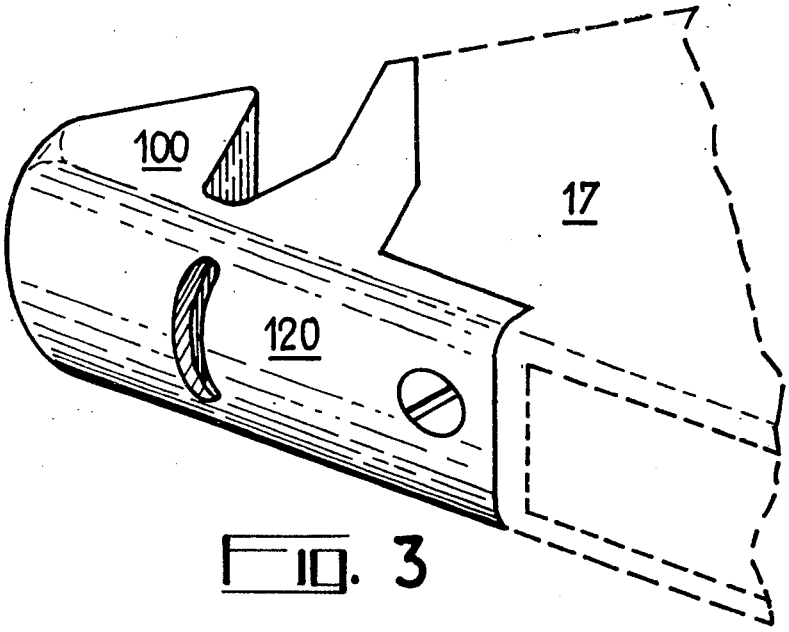
FIGS. 2 and 3 show two examples of embodiment of an extractive electrode according to the invention.

To enable the extractive electrode to be placed as close as possible to the source S, the entry surface 120 of the block 100 may be convex in shape, as illustrated in FIG. 3.

Figure 4:
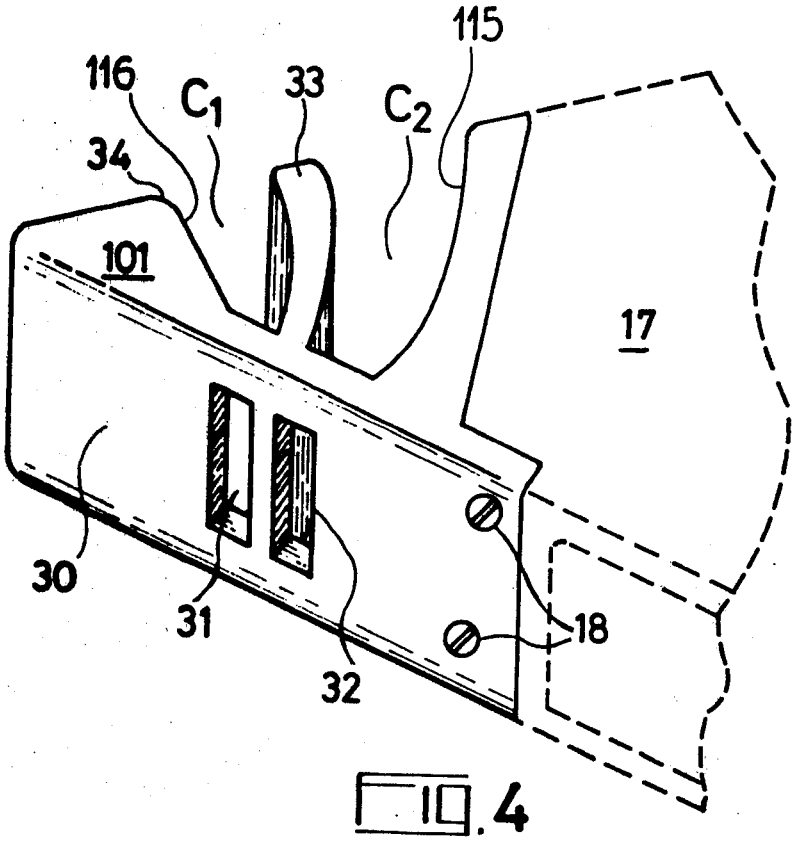
FIGS. 4 to 10 illustrate further examples of embodiment of an extractive electrode according to the invention.

FIG. 4 shows another example of embodiment of an extractive electrode according to the invention. This electrode formed by a block 101 comprising in its entry face 30 two windows 31 and 32 opening onto two channels $C_1$ and $C_2$ separated from one another by a median element 33, these two channels $C_1$ and $C_2$ becoming progressively wider and opening at the exit face 34. These channels $C_1$ and $C_2$ allow the passage of two particle beams corresponding to two possible operations of the cyclotron at frequencies of different harmonic orders. The form of the median element 33 is defined by the characteristics of the beam and the accelerator.

Figure 5:
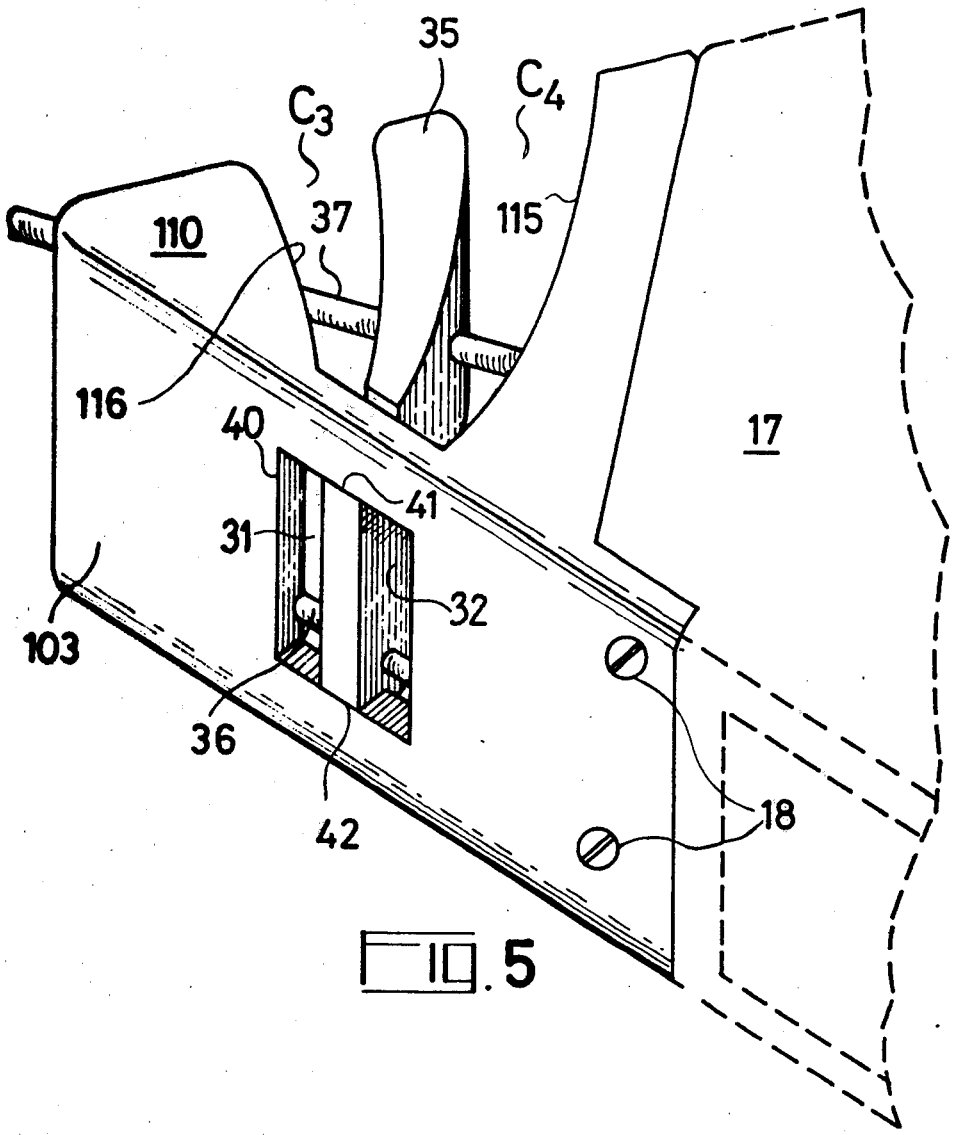
Figure 6:
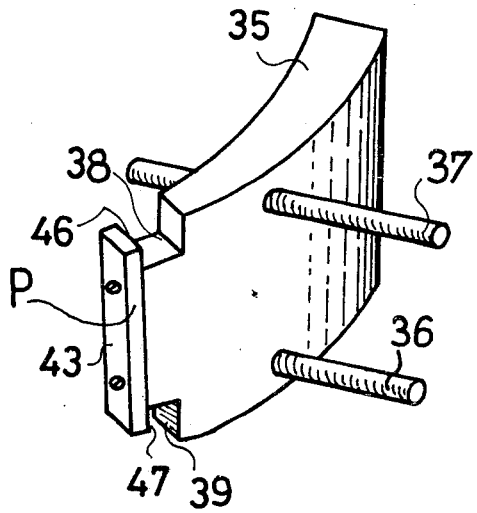
Figure 7:
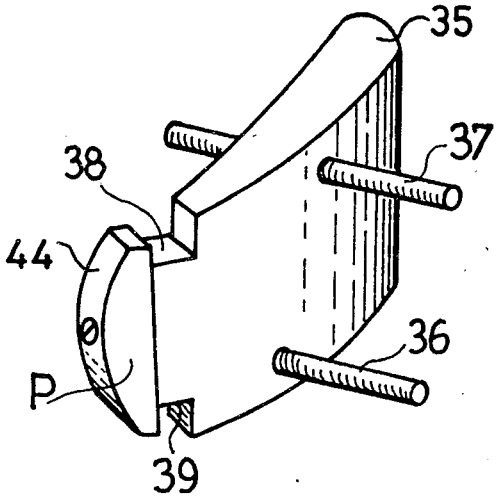
Figure 8:
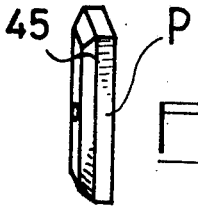

In another example of embodiment shown in FIG. 5, the block 110 forming the extractive electrode is formed with two channels $C_3$ and $C_4$ separated by a displaceable median element 35 enabling the width of the channels $C_3$ and $C_4$ to be varied. In this embodiment, the median element 35 has two rods 36 and 37 integral with the block 110 extending through it. These two rods 36 and 37, which are parallel to the plane of the mean trajectories of the beam, enable the median element 35 to be guided during its positioning relative to the lateral walls 115 and 116. One of these rods, for example the rod 36, acts as a guide whilst the rod 37 is screw threaded and enables the median element 35 to be gradually displaced. The FIGS. 6 and 7 show in detail two modified embodiments of the displaceable median element 35. The end of this median element 35 situated at the entrance of the extractive electrode is formed with two shoulders 38 and 39 which enable the median element 35 to engage on one hand in an aperture 40 divided in two parts by the median element 35 to form the windows 31, 32, and to slide on the other hand, along the upper and lower edges 41 and 42, respectively, of this aperture 40 (FIG. 5). The median element 35 may be kept in the selected position by means of a plate P fixed to the end of the median element 35 comprising the shoulders 38 and 39, the edges 46, 47 (FIG. 6) of the plate P resting on the entry face 103 of the extractive electrode (FIG. 5). This plate P (FIG. 6) has a flat outer surface 43 corresponding to the surface directed towards the particle source S. This plate P may have a convex outer surface 44, as illustrated in FIG. 7, or may have a projecting outer surface 45 trapezoidal in shape, as illustrated in FIG. 8. The choice of the shape and dimensions of the outer surface 43 to 45 of the plate P makes it possible to obtain a vertical focusing component of the required value, this focusing component being attributable to the hyperfrequency electrical field prevailing between the source 1 and the "Dee" in the vicinity of the source S.

Figure 9:
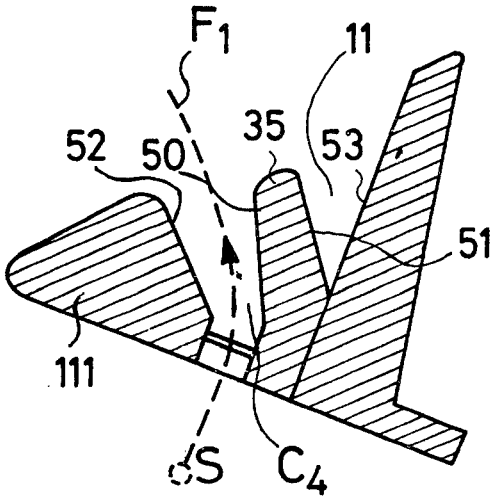
Figure 10:
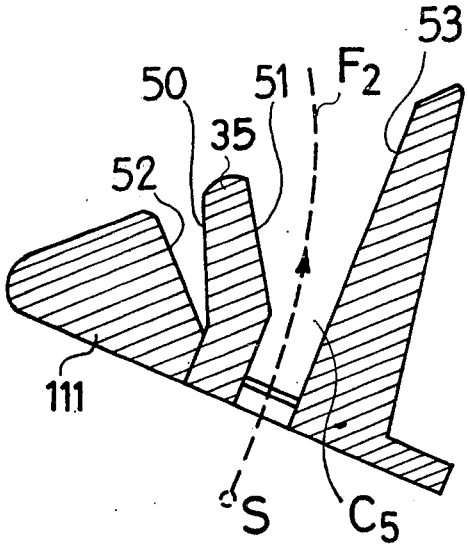

In another embodiment, the median element 35 may have lateral surfaces 50 and 51 as shown in FIGS. 9 and 10, these lateral surfaces 50 and 51 being able to apply with precision either to the lateral wall 52 or to the lateral wall 53 of the notch 11 in the block 111. The channels $C_4$ as shown in FIG. 9, or $C_5$ (FIG. 10) thus obtained would be well-defined.

The channels $C_4$ and $C_5$ allow the passage of two beams $F_1$ and $F_2$ coming from one and the same source S, but corresponding to the operation of the cyclotron at two harmonic frequencies for example.

The extractive electrode according to the invention may be used with advantage.

in cyclotrons comprising "Dees" of low height (in this case, the vertical focusing and defocusing effects attributable to the hyperfrequency electrical field are significant in the two first accelerating spaces and the extractive electrode enables these effects, which are harmful to the smooth operation of the cyclotron, to be corrected, when the cyclotron is intended to operate at a high harmonic order (heavy ion cyclotron for example). In this case, the magnetic field "hump" contributing to the vertical focusing of the beam in the central zone of the cyclotron should not be too large so as to limit the phase drift which is proportional to the amplitude of this "hump" and to the harmonic order. The use of the extractive electrode according to the invention by which the focusing and defocusing effects attributable to the hyperfrequency electrical field can be made very weak, eliminates the need for a significant increase in the value of the magnetic field in the accelerating space.

What we claim is:

1. An extractive electrode intended to be positioned in the vicinity of a source of a charged particle beam of an accelerator of the cyclotron type, said particle source being substantially located in the center of said cyclotron, said accelerator comprising at least two electrodes or "Dees" located between the polepieces of an electromagnet and means enabling an accelerating hyperfrequency electrical field to be created in accelerating spaces situated between said "Dees" for periodically accelerating said particles, said extractive electrode being constituted with a metallic block substantially prismatic in shape and removably fixed to the extremity of one of said "Dees," said block having an entry face facing said particle source and an exit face, said entry face being provided with two windows for the passage of said particles, said windows opening respectively onto two deep notches formed in said block, said notches being only delimited by two curved lateral walls and a curved median element arranged between said lateral walls for forming two channels for the passage of said particles, said channels opening at said exit face onto one of said accelerating spaces, said hyperfrequency electrical field having in said channels a component of low value along a line perpendicular to the plane of the mean path of said particles.

2. An extractive electrode as claimed in claim 1, wherein said median element is fixed.

3. An extractive electrode as claimed in claim 1, wherein said median element is displaceable.

4. An extractive electrode as claimed in claim 3, wherein said median element has curved lateral faces of such a shape that said lateral faces can be respectively applied to one and the other of said lateral walls of said notches.

5. An extractive electrode as claimed in claim 3, wherein at least a rod is arranged parallel to the plane of said mean path of said beam, said rod extending through said median element, said median element being able to displace along said rod.

6. An extractive electrode as claimed in claim 5, said extractive electrode being provided with two rods, parallel to said plane of the mean path of said beam, said rods extending through said median element, said median element being adapted for displacement along said two rods, one of said two rods being provided with a screw thread enabling said median element to be progressively displaced.

7. An extractive electrode as claimed in claim 3, wherein said median element is provided at one of its ends with an upper shoulder and with a lower shoulder enabling it to engage in an aperture cuts within said entry face of said extractive electrode, said aperture being divided into two parts by means of said median element which determines said two windows, said median element being able to slide along said upper and lower edges of said aperture.

8. An extractive electrode as claimed in claim 7, wherein said median element is provided with a removable plate mechanically fixed to the extremity of said median element which is located in front of said source and comprises said shoulders, said removable plate being substantially equal in height to the height of said median element, said removable plate being intended to rest on said entry face of the block forming the extractive electrode.

9. An extractive electrode as claimed in claim 8, wherein said plate which is rectangular in shape has a flat outer surface.

10. An extractive electrode as claimed in claim 8, wherein said plate which is rectangular in shape has a convex projecting outer surface.

11. An extractive electrode as claimed in claim 8, wherein said plate which is rectangular in shape has a trapezoidal projecting outer surface.

* * * * *